US010961990B2

(12) United States Patent
Achten

(10) Patent No.: US 10,961,990 B2
(45) Date of Patent: Mar. 30, 2021

(54) HYDRAULIC DEVICE

(71) Applicant: INNAS BV, Breda (NL)

(72) Inventor: Peter Augustinus Johannes Achten, Eindhoven (NL)

(73) Assignee: INNAS BV

( * ) Notice: Subject to any disclaimer, the term of this patent is extended or adjusted under 35 U.S.C. 154(b) by 0 days.

(21) Appl. No.: 16/609,974

(22) PCT Filed: May 2, 2018

(86) PCT No.: PCT/EP2018/061117
§ 371 (c)(1),
(2) Date: Oct. 31, 2019

(87) PCT Pub. No.: WO2018/202665
PCT Pub. Date: Nov. 8, 2018

(65) Prior Publication Data

US 2020/0063722 A1 Feb. 27, 2020

(30) Foreign Application Priority Data

May 3, 2017 (EP) ..... 17169272

(51) Int. Cl.
*F04B 1/20* (2020.01)
*F04B 1/2014* (2020.01)
*F04B 53/14* (2006.01)

(52) U.S. Cl.
CPC ..... *F04B 1/2014* (2013.01); *F04B 53/14* (2013.01)

(58) Field of Classification Search
CPC ..... F01L 33/0085; F04B 1/124; F04B 1/24; F04B 53/14; F04B 53/144; F16J 1/005; F16J 1/12
See application file for complete search history.

(56) References Cited

U.S. PATENT DOCUMENTS 3,057,668 A * 10/1962 Cornelius ..... F01B 3/0032 92/257
4,363,294 A * 12/1982 Searle ..... F01B 15/00 123/193.6

(Continued)

FOREIGN PATENT DOCUMENTS

DE 102007011441 A1 9/2008
WO 03058035 A1 7/2003
WO 2006083163 A1 8/2006

OTHER PUBLICATIONS

International Search Report and Written Opinion for International Application No. PCT/EP2018/061117; dated Jun. 7, 2018 (7 pages).

*Primary Examiner* — Abiy Teka
*Assistant Examiner* — Matthew Wiblin
(74) *Attorney, Agent, or Firm* — Mendelsohn Dunleavy, P.C.

(57) ABSTRACT

A hydraulic device (1) comprises a housing (27), a shaft (2) which is mounted in the housing (27) and rotatable about a first axis of rotation (4), wherein the shaft (2) has a flange (8) extending perpendicularly to the first axis (4), a plurality of pistons (9) which are fixed to the flange (8) at equiangular distance about the first axis of rotation (4), and a plurality of cylindrical sleeves (10) cooperating with the pistons (9) to form respective compression chambers (11) of variable volume. The sleeves (10) are rotatable about a second axis of rotation which intersects the first axis of rotation (4) by an acute angle such that upon rotating the shaft (2) the volumes of the compression chambers (11) change. Each piston (9) has a piston head (14) including a ball-shaped circumferential outer side. Each of the pistons (9) has a modular structure comprising a piston head member (14) which forms the piston head, a piston pin (20) which is fixed to the flange (8) and to which the piston head member (14) is mounted, and a spacer (26) which is located at the outer side (Continued)

of the piston pin (20) and sandwiched between the piston head member (14) and the flange (8).

20 Claims, 2 Drawing Sheets

(56) References Cited

U.S. PATENT DOCUMENTS

| | | | | |
|---|---|---|---|---|
| 5,249,506 | A * | 10/1993 | Willimczik | F01B 3/0032 417/462 |
| 5,304,043 | A * | 4/1994 | Shilling | F04B 27/0804 417/269 |
| 5,564,327 | A * | 10/1996 | Sims | F16J 1/12 74/579 E |
| 5,636,561 | A * | 6/1997 | Pecorari | F04B 1/24 91/499 |
| 5,794,514 | A * | 8/1998 | Pecorari | F04B 1/124 417/269 |
| 6,152,014 | A * | 11/2000 | Willimczik | F01B 3/0038 417/269 |
| 8,297,239 | B2 * | 10/2012 | Kwok | F01B 3/0041 123/43 A |
| 2004/0173089 | A1 * | 9/2004 | Gray, Jr. | F04B 1/124 91/505 |
| 2006/0012881 | A1 | 1/2006 | Mearini et al. | |
| 2013/0195687 | A1 * | 8/2013 | Achten | F04B 1/306 417/222.1 |
| 2015/0361971 | A1 * | 12/2015 | Wood | F04B 39/0005 92/240 |
| 2017/0335820 | A1 * | 11/2017 | Pecorari | F04B 1/2014 |

* cited by examiner

HYDRAULIC DEVICE

The present invention relates to a hydraulic device according to the preamble of claim 1.

Such a hydraulic device is known from WO 2006/083163. The shaft has a flange which extends perpendicularly to the first axis and the pistons are fixed to the flange at equiangular distance about the first axis of rotation. An equal number of cylindrical sleeves are supported by a barrel plate and rotate together with the barrel plate about the second axis of rotation which is angled with respect to the first axis of rotation. Each piston is sealed directly to the inner wall of the corresponding cylindrical sleeve, i.e. without using a piston ring. During rotation of the barrel plate the cylindrical sleeve makes a combined translating and swivelling motion around the piston. Therefore, the circumferential outer side of each piston head is ball-shaped. It is noted that the ball-shape creates a sealing line between the piston and the cylindrical sleeve which extends perpendicularly to the centre line of the cylindrical sleeve. Due to required accuracy of dimensions of the pistons, manufacturing of the pistons is rather expensive.

An object of the invention is to provide a hydraulic device which can be manufactured in a low-cost manner.

This object is accomplished with the hydraulic device according to the invention, which is characterized in that each of the pistons has a modular structure comprising a piston head member which forms the piston head, a piston pin which is fixed to the flange and to which the piston head member is mounted, and a spacer which is located at the outer side of the piston pin and sandwiched between the piston head member and the flange.

An advantage of the invention is that the piston head member, which is a part that requires a tight tolerance, is only a part of the entire piston in assembled condition. The remainder of the piston parts requires less tight tolerances such that the total manufacturing costs of the hydraulic device can be minimized. Due to its relatively small dimensions the piston head member may be manufactured by means of forging or stamping, for example.

The spacer supports the piston head member with respect to the flange and may be clamped between the piston head member and the flange upon mounting the piston parts to the flange.

In a specific embodiment play is present between the piston pin and the spacer. This means that a torque and/or a lateral force onto the piston can be absorbed by the flange rather than the piston pin, since under operating conditions the spacer is pressed against the flange by hydrostatic pressure in the compression chamber.

In a practical embodiment the spacer is a bush, which surrounds the piston pin. The bush may have a concentrical and cylindrical inner and outer side. Such a bush can be manufactured by cutting pieces from a pipe at relatively low cost.

The piston head member may have a central through-hole through which the piston pin extends.

The piston head member may be fixed to the piston pin in axial direction of the piston pin through a press fitting between a surrounding wall of the central through-hole and an outer surface portion of the piston pin.

The piston pin may partly extend beyond the piston head member as seen from the flange in order to minimize dead volume in the compression chamber if the extension protrudes in an oil discharge channel of the sleeve in top dead centre of the piston, for example. This has an advantageous effect on noise emission and hydraulic efficiency of the hydraulic device.

In a preferred embodiment the piston head member comprises a circular recess around a centre line of the piston pin at a side of the piston head member facing away from the flange. In this case the piston head member has a circumferential wall including the ball-shaped circumferential outer side and an opposite inner side which borders the recess. The resulting circumferential wall has the following effect under operating conditions. Due to internal pressure in the compression chamber the cylindrical sleeve deforms in radial direction under operating conditions. The recess in the piston head member forms part of the compression chamber and serves to deform the piston head member at the sealing line such that expansion of the piston head member follows the sleeve expansion. Consequently, leakage flow between the piston and the cylindrical sleeve at the sealing line is minimized.

In an alternative embodiment the piston pin has a piston pin shank which is fixed to the flange and extends through the through-hole and a piston pin head, wherein the piston head member is sandwiched between the piston pin head and the spacer. Due to the presence of the piston pin head which has a larger diameter than the piston pin shank, axial fixing of the piston head member is relatively simple between the spacer and the piston pin head.

Preferably, a concave transition zone is present between the piston pin head and the piston pin shank, wherein the piston pin head and the piston head member contact each other within the transition zone, since this provides a more or less automatic centring position of the piston head member with respect to the piston pin.

In a particular embodiment the piston head member is cup-shaped including a circumferential wall which has an inner side opposite to said ball-shaped circumferential outer side, which wall surrounds a cavity in which the piston pin head is located such that a circumferential outer side of the piston pin head faces the inner side of the circumferential wall of the piston head member. The cup-shaped piston head member provides a cavity which accommodates the piston pin head such that the height of the piston head member and the piston pin head together in longitudinal direction of the piston pin can be limited.

Preferably, a slot-shaped cavity is present between the inner side of the circumferential wall and the circumferential outer side of the piston pin head because of the reasons as described hereinbefore in relation to another embodiment: due to internal pressure in the compression chamber the cylindrical sleeve deforms in radial direction under operating conditions. The slot-shaped cavity in the piston head member forms part of the compression chamber and serves to deform the piston head member at the sealing line such that expansion of the piston head member follows the sleeve expansion. Consequently, leakage flow between the piston and the sleeve at the sealing line is minimized.

The outer side of the piston pin head and the inner side of the circumferential wall of the piston head member may be parallel in circumferential direction.

The piston pin head may partly extend beyond the piston head member as seen from the flange.

A further benefit is achieved when an end portion of the piston pin is clamped in the flange, since this is a relatively simple manufacturing step.

Under operating conditions of the hydraulic device the spacer is pressed against the flange up to a high level. For that reason, a contact area between the spacer and the flange should be relatively large, for example larger than the cross-sectional area of the piston pin at the flange. The ratio may even be larger than two.

The invention will hereafter be elucidated with reference to very schematic drawings showing embodiments of the invention by way of example.

Figure 1:
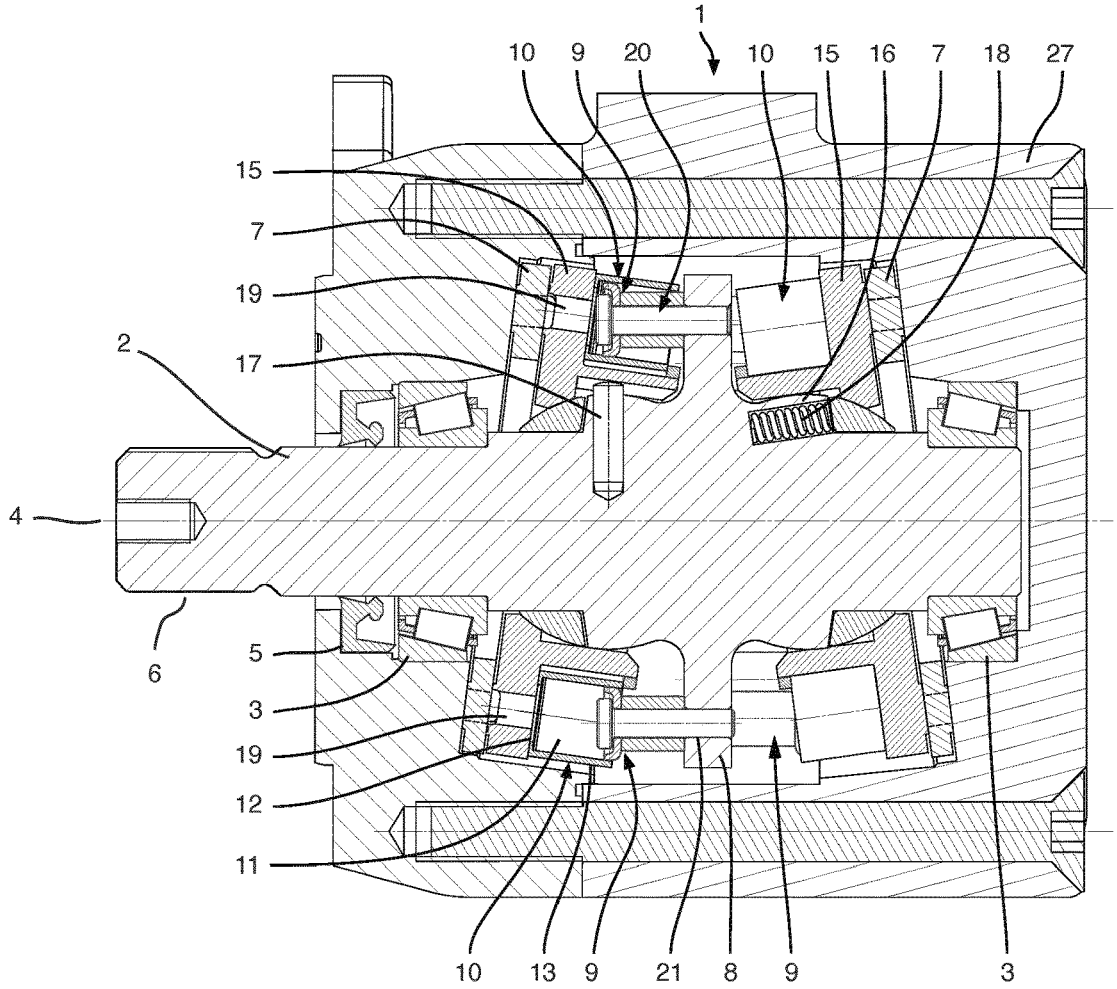
FIG. 1 is a cross-sectional view of an embodiment of a hydraulic device according to the invention.

FIG. 1 shows internal parts of a hydraulic device 1, such as a pump or hydromotor, which are fitted into a housing 27 in a known manner. The hydraulic device 1 is provided with a shaft 2 which is supported by bearings 3 at both sides of the housing 27 and which is rotatable about a first axis of rotation 4. The housing 27 is provided on the one side with an opening with a shaft seal 5 in a known manner, as a result of which the end of the shaft 2, which is provided with a toothed shaft end 6, protrudes from the housing 27. A motor can be coupled to the toothed shaft end 6 if the hydraulic device 1 is a pump, and a driven tool can be coupled thereto if the hydraulic device 1 is a motor.

The hydraulic device 1 comprises face plates 7 which are mounted inside the housing 27 at a distance from each other. The face plates 7 have a fixed position with respect to the housing 27 in rotational direction thereof. The shaft 2 extends through central through-holes in the face plates 7.

The shaft 2 is provided with a flange 8 which extends perpendicularly to the first axis of rotation 4. A plurality of pistons 9 are fixed at both sides of the flange 8 at equiangular distance about the first axis of rotation 4, in this case fourteen pistons 9 on either side. Each of the pistons 9 has a modular structure which will be explained hereinafter. The pistons 9 have centre lines which extend parallel to the first axis of rotation 4. The planes of the face plates 7 are angled with respect to each other and with respect to the plane of the flange 8 in the embodiment as shown in FIG. 1.

Figure 2:
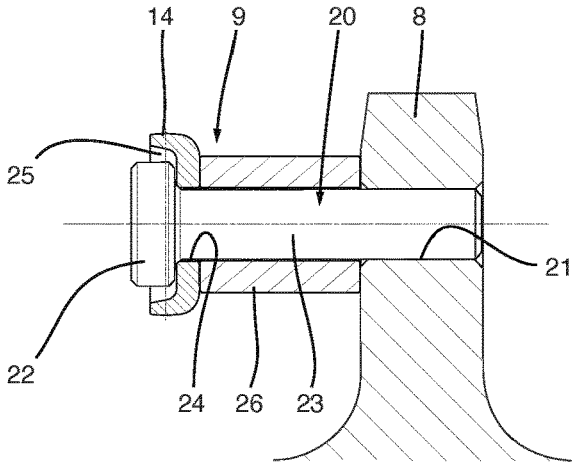
FIG. 2 is a cross-sectional view of a part of the embodiment of FIG. 1 on a larger scale.

Each of the pistons 9 cooperates with a cylindrical sleeve 10 to form a compression chamber 11 of variable volume. The hydraulic device 1 as shown in FIG. 1 has 28 compression chambers 11. The cylindrical sleeve 10 comprises a sleeve bottom 12 and a sleeve jacket 13. Each piston 9 is sealed directly to the inner wall of the sleeve jacket 13 through a piston head which is formed by a piston head member 14. The piston head member 14 is a part of the modular piston 9 and has a ball-shaped circumferential outer side. FIG. 2 shows the piston 9 including the piston head member 14 on a larger scale.

The sleeve bottoms 12 of the respective cylindrical sleeves 10 are supported by respective barrel plates 15 which are fitted around the shaft 2 by means of respective ball hinges 16 and are coupled to the shaft 2 by means of keys 17. Consequently, the barrel plates 15 rotate together with the shaft 2 under operating conditions. The barrel plates 15 rotate about respective second axes which are angled with respect to the first axis of rotation 4. This means that the cylindrical sleeves 10 also rotate about the respective second axes of rotation. As a consequence, upon rotating the shaft 2 the volumes of the compression chambers 11 change. During rotation of the barrel plates 15 each cylindrical sleeve 10 makes a combined translating and swivelling motion around the cooperating piston 9. Therefore, the outer side of each piston head member 14 is ball-shaped. The ball-shape creates a sealing line between the piston 9 and the cylindrical sleeve 10 which extends perpendicularly to the centre line of the cooperating cylindrical sleeve 10. The diameter of each piston 9 near the flange 8 is smaller than at the piston head member 14 in order to allow the relative motion of the cooperating cylindrical sleeves 10 about the pistons 9.

The sides of the respective barrel plates 15 which are directed away from the flange 8 are supported by respective supporting surfaces of the face plates 7. Due to the inclined orientation of the face plates 7 with respect to the flange 8 the barrel plates 15 pivot about the ball hinges 16 during rotation with the shaft 2. The angle between the first axis of rotation and the respective second axes of rotation is approximately nine degrees in practice, but may be smaller or larger.

The barrel plates 15 are pressed against the respective face plates 7 by means of springs 18 which are mounted in holes in the shaft 2. The compression chambers 11 communicate via a central through-hole in the respective sleeve bottoms 12 with cooperating passages 19 in the barrel plates 15. The passages 19 in the barrel plates 15 communicate via passages in the face plates 7 with a high-pressure port and a low-pressure port in the housing 27.

FIG. 1 shows that each piston 9 is fixed to the flange 8 by means of a piston pin 20 which is pressed into a flange hole 21. FIG. 2 shows the press fitting for one piston 9. The flange 8 is provided with 28 flange holes 21, such that the pistons 9 on either side of the flange 8 alternately move into the top dead centre and bottom dead centre, which refers to the position where the volume of the compression chambers 11 is at its minimum and maximum, respectively. Consequently, in circumferential direction of the flange 8 adjacent flange holes 21 receive pistons 9 on either side of the flange 8.

FIG. 2 shows one piston 9 of an embodiment of the hydraulic device 1. The piston head member 14 is cup-shaped and has a circumferential wall which has an inner side opposite to its ball-shaped outer side. The piston pin 20 has a piston pin head 22 and a piston pin shank 23. The diameter of the piston pin head 22 is larger than that of the piston pin shank 23. The piston pin shank 23 extends through a central through-hole 24 of the piston head member 14 and an end portion of the piston pin shank 23 is clamped in the flange hole 21. The modular piston 9 also comprises a spacer in the form of bush 26 which surrounds the piston pin shank 23 and is sandwiched between the piston head member 14 and the flange 8. In the embodiment as shown the bush 26 has concentrical and cylindrical inner and outer surfaces. Furthermore, play is present between the piston pin shank 23 and the bush 26. The piston head member 14 is fixed to the piston pin 20 in axial direction of the piston pin 20 through a clamp connection between the piston pin head 14 and the bush 26. More specifically, the piston pin 20 is provided with a concave transition zone between the piston pin head 22 and the piston pin shank 23, whereas the clamp connection is located within the transition zone where a surrounding edge of the central through hole 24 of the piston head member 14 contacts the piston pin 20. Outside this contact location the piston pin 20 is free from the piston head member 14.

The circumferential wall of the piston head member 14 surrounds a cavity in which a part of the piston pin head 22 is located. The diameter of the inner side of the circumferential wall is larger than the diameter of the piston pin head 22. Consequently, a slot-shaped cavity 25 is present between the inner side of the circumferential wall and the outer side of the piston pin head 22. This means that under operating conditions hydraulic fluid can enter the cavity 25 and exert a force onto the circumferential wall of the piston head member 14 in order to deform the piston head member 14, which has a beneficial effect on minimizing leakage between the piston 9 and the sleeve 10, as explained hereinbefore. In the embodiment as shown in FIG. 2 the outer side of the piston pin head and the inner side of the circumferential wall of the piston head member 14 are parallel in circumferential direction. Furthermore, the piston pin head 22 partly extends beyond the piston head member 14 as seen from the flange 8.

Figure 3:
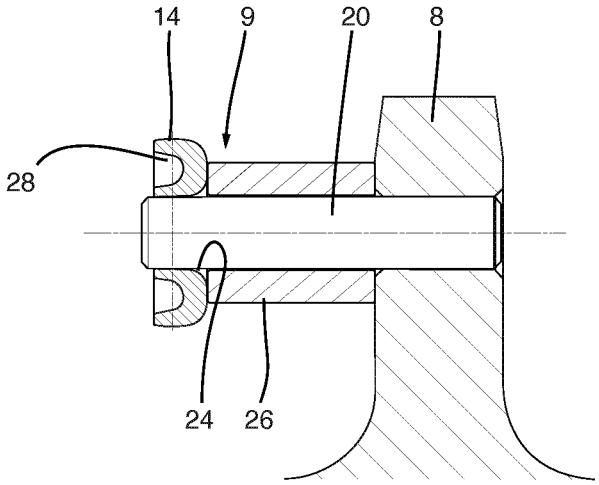
FIG. 3 is a similar view as FIG. 2, but showing an alternative embodiment.

FIG. 3 shows one modular piston 9 of an alternative embodiment of the hydraulic device 1. In this embodiment the piston pin 20 does not have a wide piston pin head, but it has a constant diameter along its longitudinal direction. The piston head member 14 is fixed to the piston pin 20 in axial direction of the piston pin 20 through a press fitting between a circumferential surface of the central through-hole 24 and an outer surface portion of the piston pin 20. The piston head member 14 is mounted onto the piston pin 20 such that the piston pin 20 partly extends beyond the piston head member 14 as seen from the flange 8. The piston head member 14 comprises a circular recess 28 around the centre line of the piston pin 20 at a side of the piston head member 14 facing away from the flange. The recess 28 is comparable to the slot-shaped cavity 25 of the embodiment as shown in FIG. 2. The recess 28 is open in a direction directed from the flange 8 towards the piston head member 14. The modular piston 9 of the embodiment as shown in FIG. 3 also comprises a bush 26 which is sandwiched between the piston head member 14 and the flange 8.

Upon assembly of the piston 9 of the embodiments as shown in FIGS. 2 and 3 the bush 26 will be clamped between the piston head member 14 and the flange 8. The clamping force may be relatively small since a large clamping force will automatically be exerted by hydrostatic pressure in the compression chamber 11 under operating conditions of the hydraulic device 1. In practice the hydrostatic pressure appears to press the bush 26 against the flange 8 up to a high level such that a transverse force resulting from the hydraulic pressure onto the piston 9 due to the angled position of the sleeve 10 with respect to the piston 9 is transferred via a contact area between the bush 26 and the flange 8. Consequently, a torque on the piston pin 23 can be minimized or even eliminated. Because of the relatively high pressure of the bush 26 onto the flange 8, the contact area should be relatively large, for example larger than the cross-sectional area of the corresponding flange hole 21. In terms of dimensions of the bush 26, the outer diameter of the bush 26 may be at least 40% larger than its inner diameter.

The invention is not limited to the embodiments shown in the drawings and described hereinbefore, which may be varied in different manners within the scope of the claims and their technical equivalents.

The invention claimed is:

1. A hydraulic device comprising a housing, a shaft which is mounted in the housing and rotatable about a first axis of rotation, wherein the shaft has a flange extending perpendicularly to the first axis of rotation, a plurality of pistons which are fixed to the flange at equiangular distance about the first axis of rotation, a plurality of cylindrical sleeves cooperating with the pistons to form respective compression chambers of variable volume, wherein the sleeves are rotatable about a second axis of rotation which intersects the first axis of rotation by an acute angle such that upon rotating the shaft the volumes of the compression chambers change, wherein each piston has a piston head including a ball-shaped circumferential outer side creating a sealing line between the piston and the cylindrical sleeve which extends perpendicularly to a center line of the cylindrical sleeve, characterized in that each of the pistons has a modular structure comprising a piston head member which forms said piston head, a piston pin which is fixed to the flange and to which the piston head member is mounted, and a spacer which is located at the outer side of the piston pin and sandwiched between the piston head member and the flange.

2. A hydraulic device according to claim 1, wherein play is present between the piston pin and the spacer.

3. A hydraulic device according to claim 2, wherein the spacer is a bush, which surrounds the piston pin.

4. A hydraulic device according to claim 1, wherein the spacer is a bush, which surrounds the piston pin.

5. A hydraulic device according to claim 4, wherein the bush has a concentrical and cylindrical inner and outer side.

6. A hydraulic device according to claim 1, wherein the piston head member has a central through-hole through which the piston pin extends.

7. A hydraulic device according to claim 6, wherein the piston head member is fixed to the piston pin in an axial direction of the piston pin through a press fitting between a surrounding wall of the central through-hole and an outer surface portion of the piston pin.

8. A hydraulic device according to claim 7, wherein the piston pin partly extends beyond the piston head member as seen from the flange.

9. A hydraulic device according to claim 6, wherein the piston pin partly extends beyond the piston head member as seen from the flange.

10. A hydraulic device according to claim 6, wherein the piston pin has a piston pin shank which is fixed to said flange and extends through said through-hole and a piston pin head, wherein the piston head member is sandwiched between the piston pin head and the spacer.

11. A hydraulic device according to claim 10, wherein a concave transition zone is present between the piston pin head and the piston pin shank, wherein the piston pin head and the piston head member contact each other within the transition zone.

12. A hydraulic device according to claim 11, wherein the piston head member is cup-shaped including a circumferential wall which has an inner side opposite to said ball-shaped circumferential outer side, which wall surrounds a cavity in which the piston pin head is located such that a circumferential outer side of the piston pin head faces the inner side of the circumferential wall of the piston head member.

13. A hydraulic device according to claim 11, wherein the piston pin head partly extends beyond the piston head member as seen from the flange.

14. A hydraulic device according to claim 10, wherein the piston head member is cup-shaped including a circumferential wall which has an inner side opposite to said ball-shaped circumferential outer side, which wall surrounds a cavity in which the piston pin head is located such that a circumferential outer side of the piston pin head faces the inner side of the circumferential wall of the piston head member.

15. A hydraulic device according to claim 14, wherein the cavity is a slot-shaped cavity and is present between the inner side of the circumferential wall of the piston head member and the circumferential outer side of the piston pin head.

16. A hydraulic device according to claim 15, wherein the outer side of the piston pin head and the inner side of the circumferential wall of the piston head member are parallel in circumferential direction.

17. A hydraulic device according to claim 14, wherein the piston pin head partly extends beyond the piston head member as seen from the flange.

18. A hydraulic device according to claim 10, wherein the piston pin head partly extends beyond the piston head member as seen from the flange.

19. A hydraulic device according to claim 1, wherein the piston head member comprises a circular recess around a center line of the piston pin at a side of the piston head member facing away from the flange.

20. A hydraulic device according to claim 1, wherein an end portion of the piston pin is clamped in the flange.

* * * * *